US010336595B2

(12) United States Patent
Matti

(10) Patent No.: US 10,336,595 B2
(45) Date of Patent: Jul. 2, 2019

(54) LOAD-SECURING DEVICE

(71) Applicant: ROGAMA B.V., Valkenburg (NL)

(72) Inventor: Rob Matti, Valkenburg (NL)

(73) Assignee: ROGAMA BV (NL)

( * ) Notice: Subject to any disclaimer, the term of this patent is extended or adjusted under 35 U.S.C. 154(b) by 34 days.

(21) Appl. No.: 15/547,295

(22) PCT Filed: Jan. 27, 2016

(86) PCT No.: PCT/EP2016/051649
§ 371 (c)(1),
(2) Date: Jul. 28, 2017

(87) PCT Pub. No.: WO2016/120303
PCT Pub. Date: Aug. 4, 2016

(65) Prior Publication Data

US 2018/0022590 A1 Jan. 25, 2018

(30) Foreign Application Priority Data

Jan. 28, 2015 (DE) ..... 10 2015 201 415

(51) Int. Cl.
*B66F 9/18* (2006.01)

(52) U.S. Cl.
CPC ..... *B66F 9/18* (2013.01)

(58) Field of Classification Search
CPC ..... B66F 9/18
(Continued)

(56) References Cited

U.S. PATENT DOCUMENTS 2,684,165 A 7/1954 Hill
2,772,800 A * 12/1956 Brady ..... B66F 9/18 414/621

(Continued)

FOREIGN PATENT DOCUMENTS

DE 297 14 803 U1 10/1997
DE 100 40 249 A1 2/2002

(Continued)

OTHER PUBLICATIONS

International Search Report for Application No. PCT/EP2016/051649 dated Mar. 22, 2016.

(Continued)

*Primary Examiner* — Mark C Hageman
(74) *Attorney, Agent, or Firm* — Tarolli, Sundheim, Covell & Tummino LLP

(57) ABSTRACT

The invention relates to a load-securing device (100), wherein the load-securing device (100) comprises at least one mast (151), a retaining element (110), a supporting element (120), and a guide rail (130), which has a curved track (131) that is bent by 90° at the lower end thereof, the load-securing device (100) is arranged on the at least one mast (151) in such a way that the load-securing device can be slid vertically in the x-direction, the guide rail (130) is extended substantially parallel to the at least one mast (151), and the supporting element (120) engages with the guide rail (130), wherein the supporting element (120) is supported by the guide rail (130) and wherein the retaining element (110) is arranged in such a way that the retaining element can be pivoted about a pivot point (112), wherein the retaining element (110) can be activated by the pivoting thereof into a substantially horizontal position, wherein the pivoting of the retaining element (110) in the vertical direction (x) is prevented by the supporting element (120).

15 Claims, 7 Drawing Sheets

Figure 1:
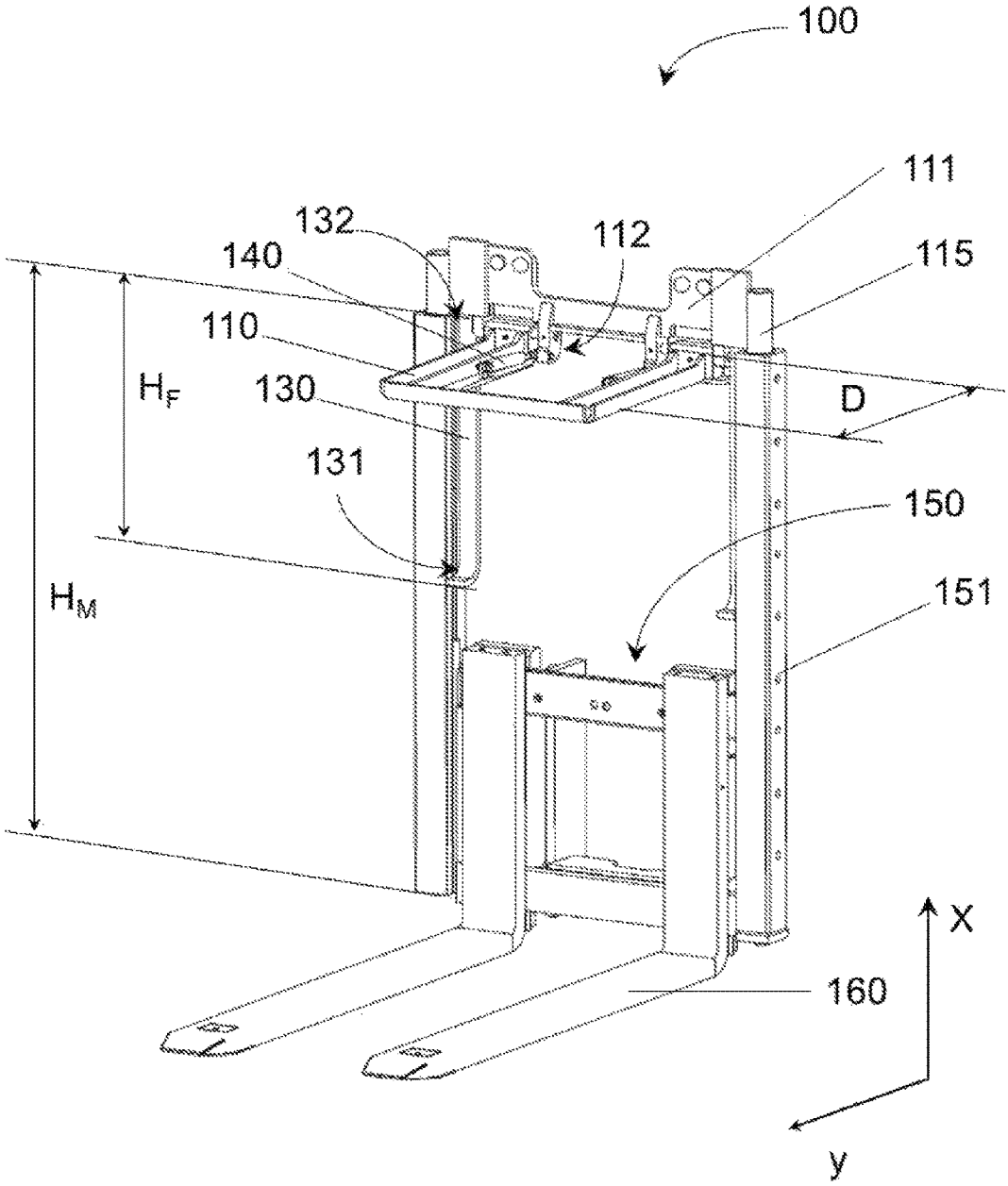

(58) Field of Classification Search
USPC ..... 414/622
See application file for complete search history.

(56) References Cited

U.S. PATENT DOCUMENTS

| | | | | | |
|---|---|---|---|---|---|
| 2,873,874 | A | * | 2/1959 | Best | B60P 3/41 414/497 |
| 3,272,364 | A | * | 9/1966 | Mindrum | B66F 9/18 187/222 |
| 3,817,567 | A | * | 6/1974 | Lull | B66F 9/18 294/104 |
| 4,116,349 | A | | 9/1978 | Durham | |
| 4,198,188 | A | * | 4/1980 | Perkins | B60P 1/4457 414/545 |
| 4,354,795 | A | | 10/1982 | Dutra, Jr. | |
| 5,374,155 | A | * | 12/1994 | Van Baale | B66F 9/18 414/607 |

FOREIGN PATENT DOCUMENTS

| | | |
|---|---|---|
| FR | 2 773 551 A1 | 7/1999 |
| GB | 714 482 A | 9/1954 |

OTHER PUBLICATIONS

Translation of the International Preliminary Report on Patentability for Application No. PCT/EP2016/051649.

* cited by examiner

LOAD-SECURING DEVICE

RELATED APPLICATIONS

The present invention is a U.S. National Stage under 35 USC 371 patent application, claiming priority to Serial No. PCT/EP2016/051649, filed on 27 Jan. 2016; which claims priority of DE 10 2015 201 415.0, filed on 28 Jan. 2015, the entirety of both of which are incorporated herein by reference.

The invention relates to a load-securing device. Furthermore, the invention relates to a lifting carriage with a load-securing device.

The term lifting carriage refers to a device that is to be installed on a lifting frame, whereby such a lifting frame is, for example, the lifting frame of an industrial floor truck and whereby a load pick-up means, for instance, a lifting fork, can be attached to the lifting carriage. Here, lifting forks are normally used in pairs so that, for example, pallets with loads on them can be securely lifted. Lifting carriages are known from the state of the art. For example, German Preliminary Published Application DE 10 2012 217 996 A1 discloses a lifting carriage which is to be installed on a lifting frame and by means of which a given lifting frame can acquire a greater lifting range, whereby it is ensured that the forks are always moved synchronously, and consequently are always at essentially the same height. The state of the art also discloses attaching the lifting forks to a lifting carriage so that they can be moved horizontally in the same direction or relative to each other. In this context, the lifting forks can be positioned individually by manually suspending them at different positions of the lifting carriage. For example, a lifting carriage is known from German Preliminary Published Application DE 10 2011 002 433 A1 in which at least two horizontally movable load pick-up elements can be moved relative to each other by means of drive elements, so that the horizontal positions of the load pick-up elements can be adjusted, not manually by repositioning them but rather by remote control, for example, from the driver's cab of an industrial floor truck, whereby the operator of the industrial floor truck does not have to get out of the driver's cab of the industrial floor truck in order to set the horizontal positions of the load pick-up elements.

When a load is picked up and lifted with a load pick-up element that is attached to such a lifting carriage, there is a risk that the load might fall off the load pick-up element. The load can fall off the load pick-up element towards three sides, namely, in the direction opposite from the lifting carriage, hereinafter referred to as the front direction, as well as in the two horizontal directions facing essentially perpendicular to the front direction, hereinafter referred to as the side directions. If the load pick-up element is a lifting fork, then providing the lifting fork with a sufficient length can reliably prevent the load from falling off in the front direction. Many industrial floor trucks have a tilting mechanism by means of which the load can be tilted by a small angle towards the back, thereby further reducing the risk of the load tipping in the front direction. Since lifting forks are normally used in pairs, it is likewise possible to reliably prevent the load from falling off sideways by selecting the horizontal position of the two lifting forks relative to each other, namely, both as far as possible on the outer edges of the load that is to be picked up, so that the load height or the height of the center of gravity of the load is adapted to the load width. The same applies for the transport of the lifted load, for example, using an industrial floor truck, especially when it is being driven crosswise to the front direction around a curve and/or on slanted or uneven ground.

In certain cases, however, the load that is to be picked up is very narrow in comparison to its height, for example, so narrow that the two lifting forks have to be positioned in such a way that they are very close to each other and possibly even touch each other in order to fit underneath the load. Such loads are normally provided with their own spacing means with respect to the ground, so that the lifting fork tines can be slid underneath the load. In some cases, however, these spacing means are dimensioned so small that only relatively thin forks fit underneath the load. The spacing means are kept so small in order to increase the packing density in shelf systems or during transport, for instance, in trucks or containers, where such loads can be stacked vertically one above the other. If such loads are also relatively long and heavy, severe sagging of the lifting forks occurs when the load is being lifted up, and the lifting forks make bouncing or rocking movements during the transport, especially over uneven ground. This is associated with an increased risk of the load falling off the lifting forks, whereby the lateral stability of the load on the lifting forks is greatly diminished by the minimal width of the load support provided by the lifting forks.

On the other hand, another requirement is that the spacing of shelves on which loads are stored should be minimized in order to save on the hall height or else in order to install the largest possible number of shelves vertically one above the other in a given hall height. This means that the lifting frames and the load-securing devices should extend as little as possible in the vertical direction. Moreover, for example, in the case of lifting frames installed on industrial floor trucks, the cross section through which drivers of the industrial floor truck can see their driving route as well as the load that is to be picked up or transported should be as large as possible.

German Preliminary Published Application DE 10 040 249 A1 describes a load-securing device that secures a load that has been placed onto a load pick-up element so that it cannot fall off during the transport. For this purpose, a load-securing device has a holding or pressing member that is connected to the load pick-up elements so that it can be raised and lowered, whereby two or more holding or pressing members can be provided at intervals over the vehicle's entire loading width formed by the units being transported.

European patent application EP 0 467 210 A1 likewise discloses a load-securing device. The load-securing device has a load-holding plate that can be moved on a guide rail parallel to the lifting frame and/or it has lateral support plates that are mounted on additional guide rails and that can be moved sideways.

U.S. Pat. No. 4,116,349 A discloses a load clamping device having a mast and a holding element, a support element and a guide rail, whereby the load clamping device is arranged so that it can move vertically on the mast, the guide rail extends essentially parallel to the mast, and the support element engages with the guide rail, whereby the support element is supported by the guide rail and whereby the pivoting of the holding element in the vertical direction is prevented by the support element.

U.S. Pat. No. 2,684,165 discloses a forklift device having an elevator frame and a supporting frame. A means for a forward and backward pivoting movement is attached to the carrying frame. A drive means can move the elevator frame laterally, without affecting the tilting. Moreover, there are means to control the tilting of the elevator frame.

British Preliminary Published Application GB 714 482 (A) discloses an industrial floor truck having a load carriage that has stub length forks and that can be moved vertically and inclined by means of a chain or cable. The load carriage also has clamps to laterally grip around a load as well as a vertically movable holding element with which the load can be held.

When it comes to the known load-securing devices, however, the flexibility of the lifting carriage is limited by the load-securing devices themselves. In the state of the art, examples are known for the solution of this problem in which the holding element can be swung aside manually or hydraulically. However, these systems severely restrict the cross section through which operators of the load-securing device can see their driving route as well as the load that is to be picked up or transported. Furthermore, the possible vertical height of the load is greatly diminished and the intrinsic weight of a lifting carriage with a mounted load-securing device is greatly increased, as a result of which the maximum load that can be picked up by the lifting carriage is correspondingly reduced.

The objective of the invention is to put forward a load-securing device with which a load can be reliably prevented from falling off the load pick-up element, even if the load that is to be picked up by a load pick-up element is narrow and/or long, whereby, in spite of the presence of the load-securing device, the cross section through which operators of the load-securing device can see their driving route as well as the load that is to be picked up or transported should not be severely restricted, and the possible vertical height of the load is not markedly restricted by the load-securing device. Moreover, the load-securing device should be designed to be as lightweight as possible.

Furthermore, the load-securing device should have the largest possible vertical adjustment range or opening range relative to the load pick-up element, so that the highest possible loads as well as lower loads can be stabilized and picked up securely and quickly and subsequently transported.

This objective is achieved according to the invention by means of a load-securing device having the features of the independent claim 1. Advantageous refinements of the method can be gleaned from the subordinate claims 2 to 14.

Another objective of the invention is to put forward a lifting carriage with a load pick-up element with which a load can be reliably prevented from falling off the load pick-up element, even if the load that is to be picked up is narrow and/or long, whereby the cross section through which operators of the lifting carriage can see their driving route as well as the load that is to be picked up or transported is not severely restricted, and so that the possible vertical height of the load is not overly restricted. Moreover, the lifting carriage should be designed to be as lightweight as possible.

This additional objective is achieved by a lifting carriage according to claim 15.

A load-securing device according to the invention is characterized in that it has at least one mast as well as a holding element, a support element and a guide rail, whereby the lower end of the guide rail, that is to say, the end located in the opposite x-direction and facing the ground, has a curved track that is curved by 90° relative to the x-axis, the load-securing device is arranged on the at least one mast so that it can be moved vertically in the x-direction, the guide rail extends essentially parallel to the at least one mast, and the support element engages with the guide rail, whereby the support element is supported by the guide rail, and whereby the holding element is arranged so that it can be pivoted around a pivot point, whereby the holding element can be activated by being pivoted into an essentially horizontal position, whereby the pivoting of the holding element in the vertical direction (x) is prevented by the support element.

The load-securing device can be activated by pivoting the holding element into an essentially horizontal position. When the holding element is in the deactivated state, it is swung aside into an essentially vertical position, so that, in this position, said holding element does not restrict the picking up of protruding loads that do not need to be secured and it maximizes the flexibility of the lifting carriage in terms of its use. Due to the fact that the holding element is supported on the guide rail, as long as the support element is engaged with the guide rail, a deflection of the holding element is mechanically prevented in a simple manner, so that no force application means such as, for example, hydraulic cylinders are needed in order to apply the holding force onto the holding element. Moreover, the hydraulic actuation system needed for a hydraulic cylinder can be dispensed with and no hydraulic hoses have to be installed. These hoses would have to be carried along over the entire vertical adjustment range of the holding element and would take up space and increase the production costs. The load-securing device can be moved in the vertical direction on the at least one mast to such an extent that the support element is no longer engaged with the guide rail. This is possible, for example, through the selection of a shorter length for the guide rail in comparison to the at least one mast. Once the support element is no longer engaged with the guide rail, the holding element can be pivoted around a pivot point into an essentially vertical position and can be deactivated in this manner. Since there is no need for force application means to apply the holding force, the structure of the load-securing device is small in size and compact, which has a positive effect on the cross section, on the ability of the operator of the load-securing device to see the driving route as well as the load that is to be picked up or transported, as well as on the intrinsic weight of the device. In this manner, the maximum weight of a load that can be picked up is only slightly restricted and the energy consumption for lifting a load is minimized. Moreover, the load-securing device has the largest possible vertical adjustment range or opening range relative to the load pick-up elements, as a result of which the highest possible loads as well as lower loads can be stabilized and picked up securely and quickly and subsequently transported.

The load-securing device can be activated and deactivated on the basis of the pivoting capability of the holding element. Consequently, in application cases in which it is not necessary or it is even undesirable to secure the load, the load-securing device can be simply swung aside into an essentially vertical position. For this purpose, the load-securing device can be moved vertically in the direction of the load pick-up element, whereby the load pick-up element can be pivoted as soon as the support element is no longer engaged with the guide rail, so that it is no longer being supported.

The load-securing device can be installed, for example, on a conventional lifting carriage that, in turn, is attached, for instance, to an industrial floor truck. The lifting carriage, in turn, can have a means that serves to enlarge the lifting range. In this case, it is advantageous for the load-securing device to be installed on the means that serves to enlarge the lifting range.

In an advantageous embodiment, the holding element can be pivoted in the positive x-direction. For this purpose, for example, the at least one mast protrudes beyond the guide rail in the positive x-direction. For deactivation purposes, the load-securing device is moved upwards in the positive x-direction on the at least one mast until the support element is no longer engaged with the guide rail. For deactivation purposes, the holding element is pivoted around the pivot point in the opposite x-direction and, in the deactivated state, faces downwards in the opposite x-direction.

In an alternative embodiment, the holding element can be pivoted in the negative x-direction. For this purpose, for example, the at least one mast protrudes beyond the guide rail in the negative x-direction. In this embodiment, for deactivation purposes, the load-securing device is moved downwards in the opposite x-direction on the at least one mast until the support element is no longer engaged with the guide rail. For deactivation purposes, the holding element is pivoted around the pivot point in the x-direction and, in the deactivated state, faces upwards in the x-direction. As a result, the lifting carriage with the deactivated load-securing device has a lower overall height than in the previously described reverse case.

In a preferred embodiment, the holding element is in an essentially vertical position in the positive y-direction and it does not extend in the positive y-direction beyond the maximum extension of the at least one mast. In this context, the positive y-direction is the direction in which the load pick-up element extends for picking up the load, in other words, the forward driving direction of an industrial floor truck. The essentially vertical position of the holding element corresponds to the deactivated state of the load-securing device. Since the holding element—when it is in the deactivated state—does not protrude beyond the at least one mast in the forward driving direction of the industrial floor truck, the structure of the load-securing device is particularly compact in this direction, so that the useful depth of the load pick-up element for picking up loads is only minimally restricted. It is especially advantageous if the load-securing device is installed on a lifting carriage in such a way that the at least one mast likewise does not protrude beyond the lifting carriage in the positive y-direction. In this case, the useful depth of the load pick-up element for picking up loads is not restricted.

Moreover, it has proven to be advantageous for the load-securing device to also have a yoke, whereby the holding element can be pivoted in the vertical direction relative to the yoke. If two essentially parallel masts are used, the yoke forms the connection bridge to the vertical holding element guides and it increases the stability of the load-securing device.

Furthermore, it has proven to be advantageous if the yoke and the holding element can be moved vertically in the same direction in the x-direction or in the opposite x-direction, whereby their vertical distance remains constant. The holding force that the load exerts against the holding element brings about a bending torque that has to be absorbed. However, since this bending torque is also transmitted to the guide rail via the support element, the yoke itself does not have to absorb any bending torque but rather only a reactive force, as a result of which it can have a lighter configuration.

In an advantageous embodiment, the load-securing device also has an energy storage means, whereby the energy storage means is tensioned when the holding element is in an essentially horizontal position. The energy storage means exerts a torque onto the holding element around the hinge pin in the pivoting direction, said torque corresponding to the deactivation of the load-securing device. As long as the support element and thus the load-securing device are in the area where the support element is engaged with the guide rail, the support element that is supported on the guide rail counters this torque. However, if the load-securing device is moved vertically in the direction of the load pick-up element until the support element is disengaged from the guide rail, the support element is no longer supported by the guide rail and the holding element pivots around the hinge pin in the vertical direction due to the torque exerted by the energy storage means, so that the load-securing device is deactivated. In this context, it is particularly advantageous that the pivoting occurs solely due to the vertical movement of the load-securing device, without any need for an additional actuator such as, for example, an additional hydraulic or pneumatic cylinder. As a result, the load-securing device has a very small configuration, which has an advantageous effect on the cross section through which operators of the lifting carriage can see their driving route as well as the load that is to be picked up and transported, and it also has an advantageous effect on the possible vertical height of the load. In addition, the weight of the lifting carriage is further reduced. Moreover, the controls needed for an actuator can be eliminated and there is no need to lay media hoses such as hydraulic or pneumatic hoses or electric cables. These hoses or cables would have to be carried along the entire vertical adjustment range of the holding element, and they would take up space and increase the production costs.

The energy storage means is connected on one side to the yoke and on the other side to the pivotable holding element. The preferred gas spring can be mounted horizontally as well as vertically.

In an advantageous embodiment, the energy storage means is a compression spring. For instance, the energy storage means can be a gas compression spring. As an alternative, the energy storage means can also be a tension spring, for example, a gas tension spring. Gas compression springs and gas tension springs are known from the state of the art. They are characterized by a large generation of force relative to their size, in addition to being lightweight and requiring no maintenance. This additionally optimizes the cross section through which operators of the lifting carriage can see their driving route as well as the load that is to be picked up and transported, and it also optimizes the possible vertical height of the load. In addition, the weight of the load-securing device is further optimized.

A great advantage of this preferred embodiment is that, if the holding element were to bump into a shelf element located above it while it is raising the load carriage, it can move along downwards counter to the spring force, thereby greatly reducing the likelihood of causing damage to the holding element and/or to the shelf. It has also proven to be advantageous for the support element to have a wear element with which the support element is supported on the guide rail. When the load-securing device is moved vertically, the support element rubs against the guide rail. Thanks to the wear element, the wear and tear is concentrated on this element, whereby the wear element can be easily replaced. This reduces the maintenance work needed for the load-securing device. The wear element can be configured, for instance, as a roller or roller bearing. As an alternative, it is also possible to provide a sliding beam as the wear element.

In an advantageous embodiment, the guide rail is operatively connected to the at least one mast. In particular, the at least one mast itself can also be configured as a guide rail.

It has been found to be advantageous for the lifting carriage to have a height adjustment mechanism for the load-securing device by means of which the load-securing device can be adjusted in the vertical direction (x) along the guide rail. Here, in an especially advantageous embodiment, the height adjustment mechanism is integrated into the at least one mast. Owing to the integration of the height adjustment mechanism into the at least one mast, the height adjustment mechanism is largely protected against mechanical damage and does not require any additional installation space. For example, the height adjustment mechanism can be a spindle, for instance, a recirculating ball screw, or a hydraulic cylinder. In this context, the height adjustment mechanism in the area just before the final position concurrently constitutes the actuation member by means of which the holding element is pivoted and thus by means of which the load-securing device is activated or deactivated.

The height adjustment mechanism has at least one guide profile. Preferably, the height adjustment mechanism has two guide profiles that face away from the direction of a picked-up load, that is to say, they are arranged behind load pick-up elements that are installed on the lifting carriage or else to the side thereof. The at least one height adjustment mechanism can be installed outside of the guide profile or else can be integrated into the guide profile, as a result of which it is advantageously protected. If the guide is sufficiently long, the height adjustment mechanism can be integrated into only one guide profile, whereby only one profile runs in the other guide profile.

In another advantageous embodiment, the holding element has a maximum extension D from the hinge pin in the direction opposite from the hinge pin, whereby the length $H_F$ of the guide rail corresponds to at least the extension D of the holding element. With such a size relationship, the holding element can be especially easily swung aside completely into an essentially vertical position, so that, when it is in the deactivated state, it has no extension that protrudes in the positive y-direction beyond the at least one mast and consequently does not restrict the maximum useful depth of the load pick-up element.

Additional advantages, special features and practical refinements of the invention can be gleaned from the subordinate claims and from the presentation below of preferred embodiments making reference to the figures.

Figure 2:
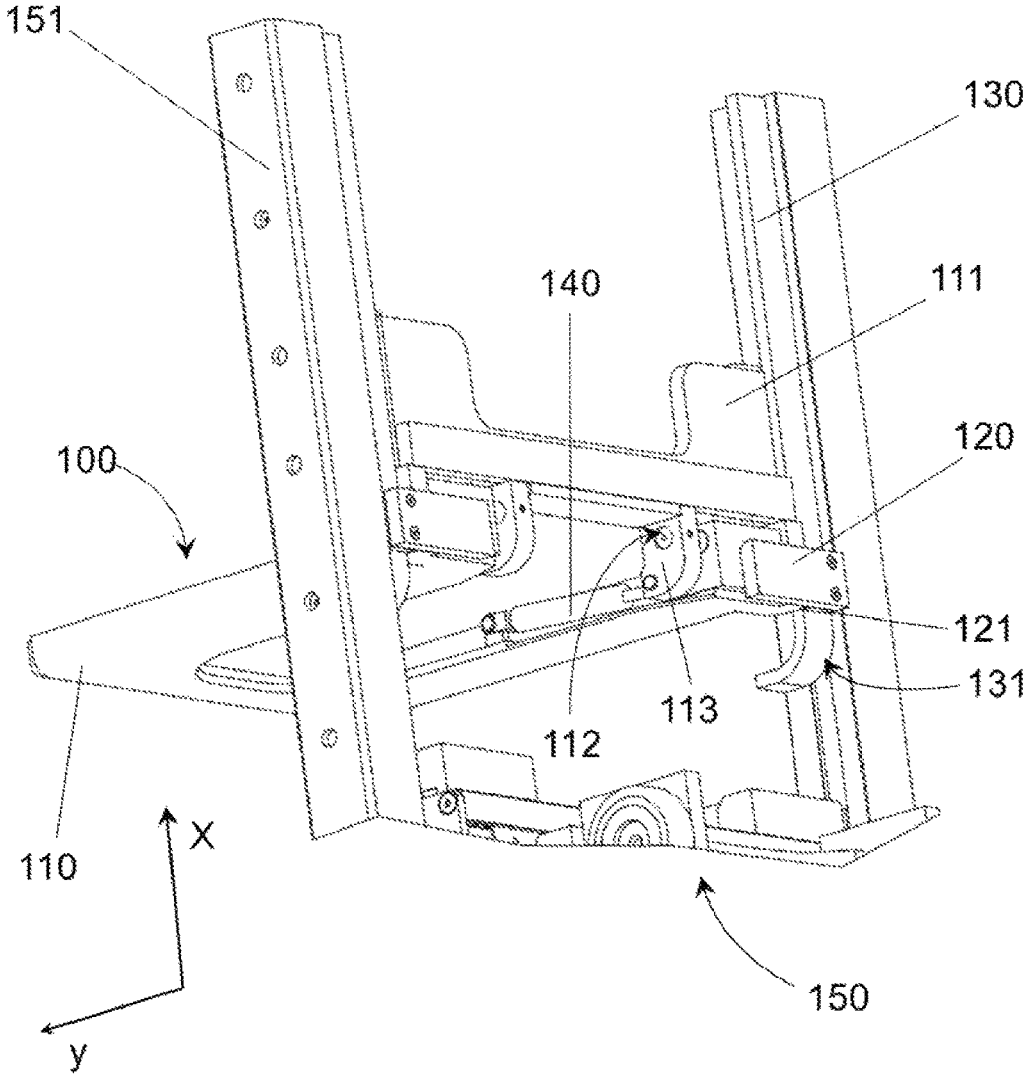
Figure 3:
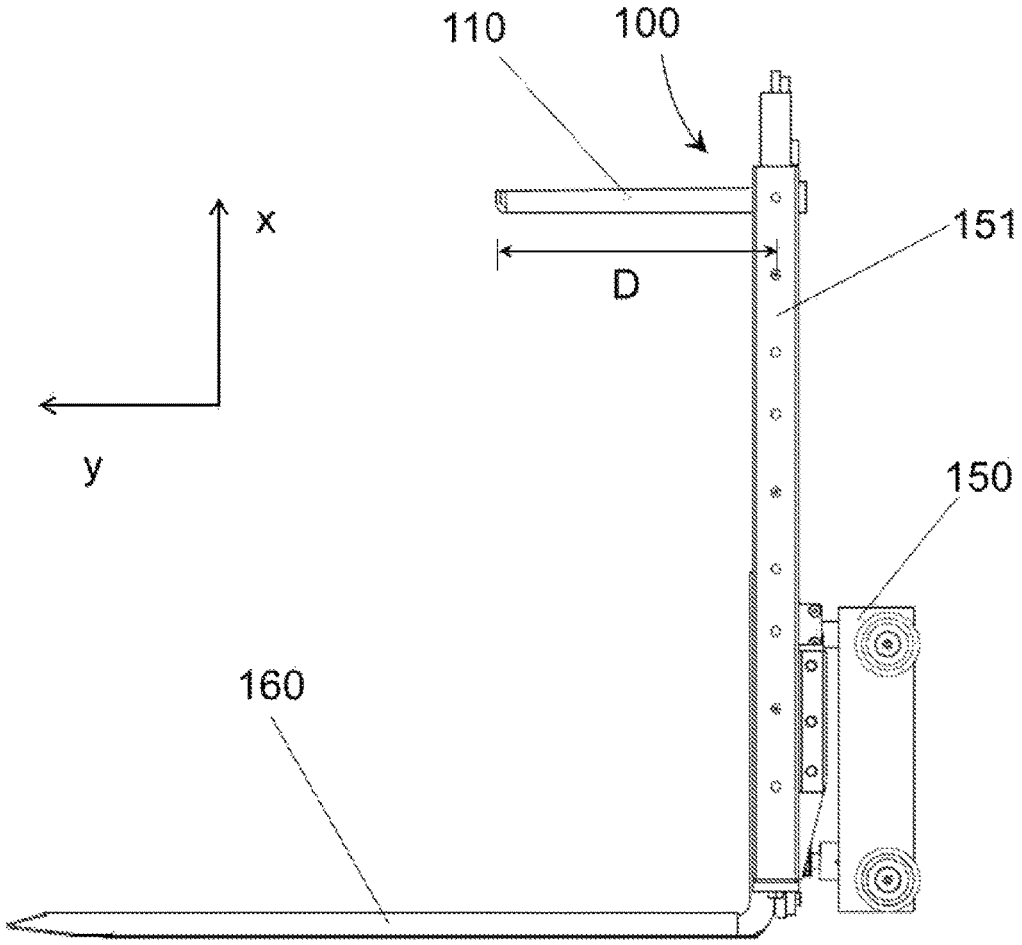
Figure 4:
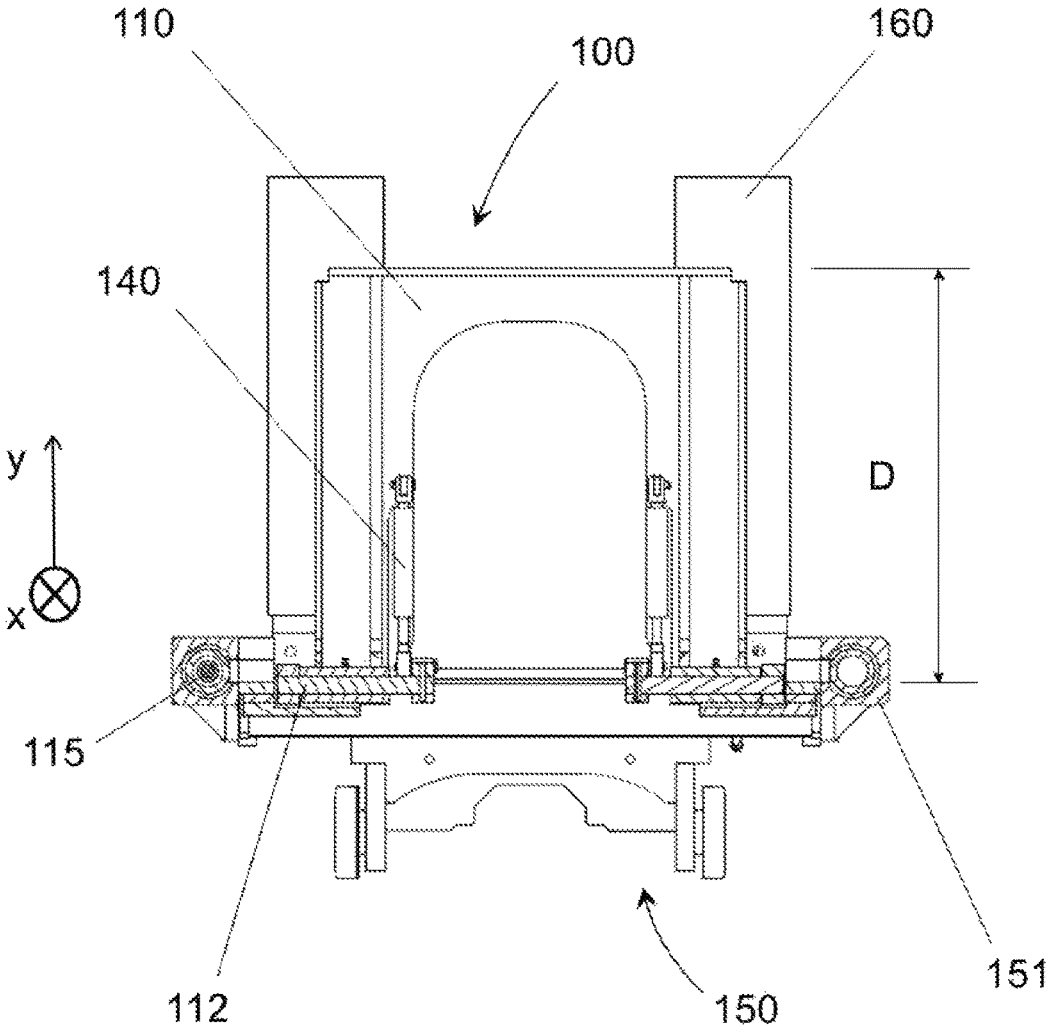
Figure 5:
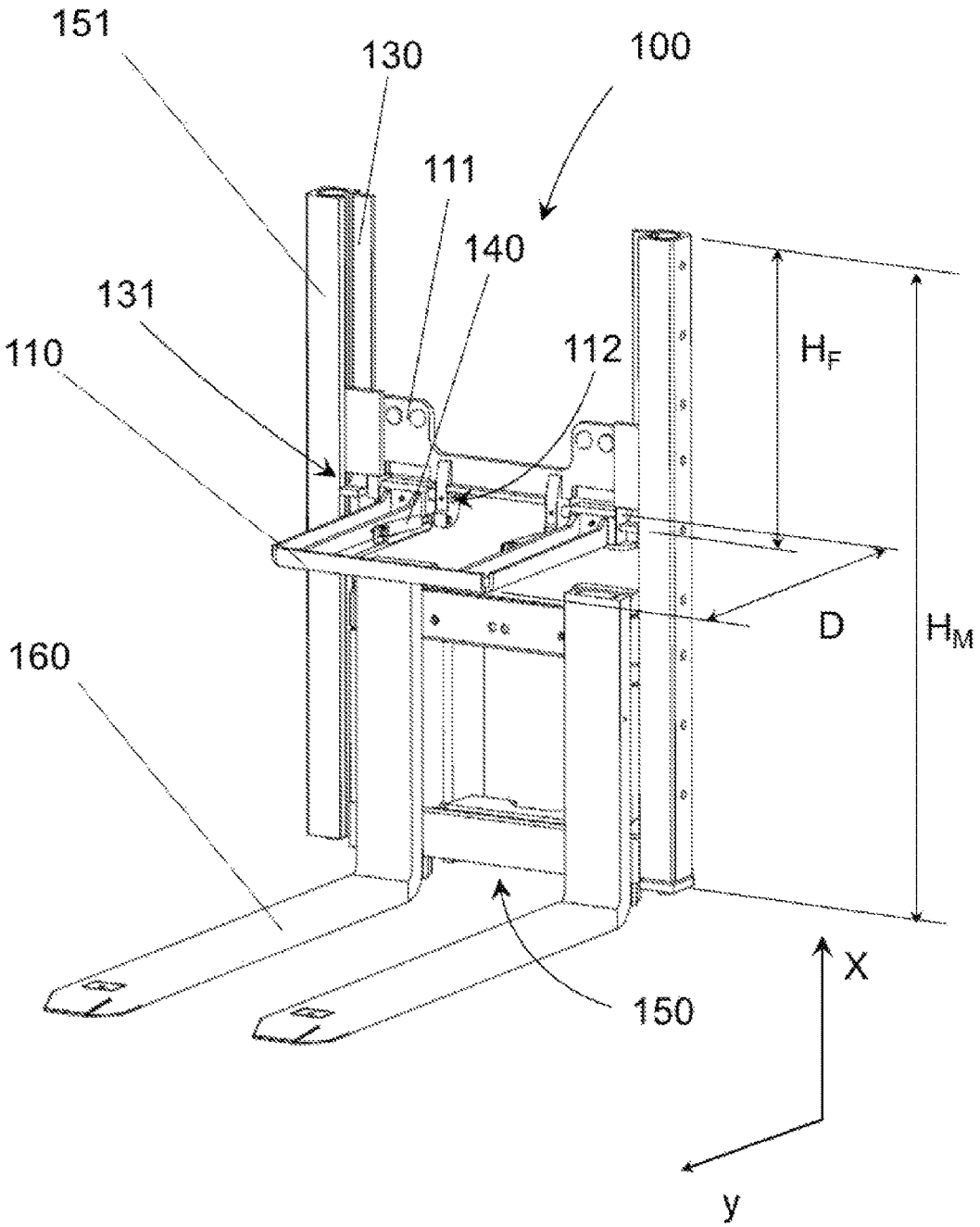
Figure 6:
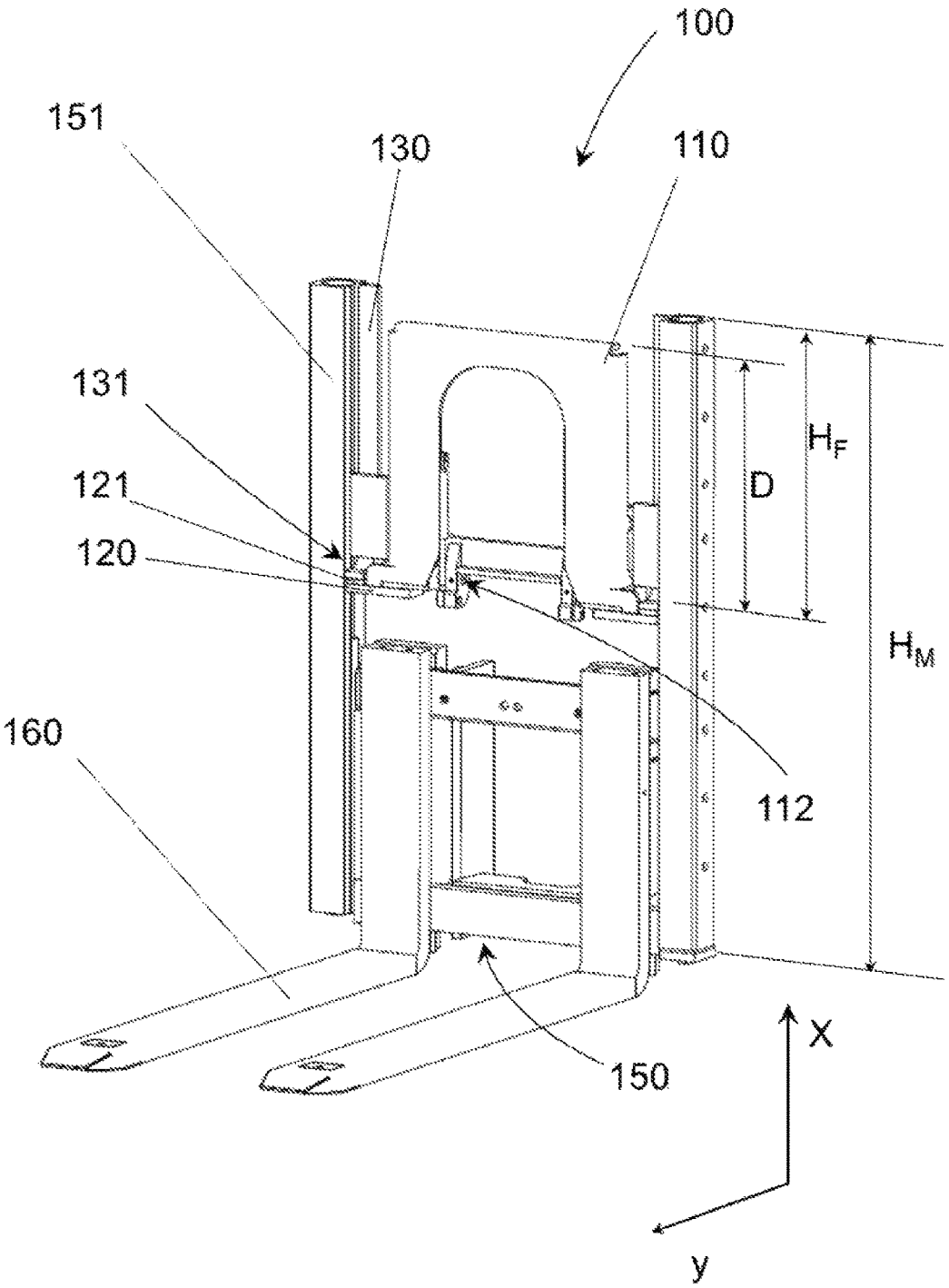
Figure 7:
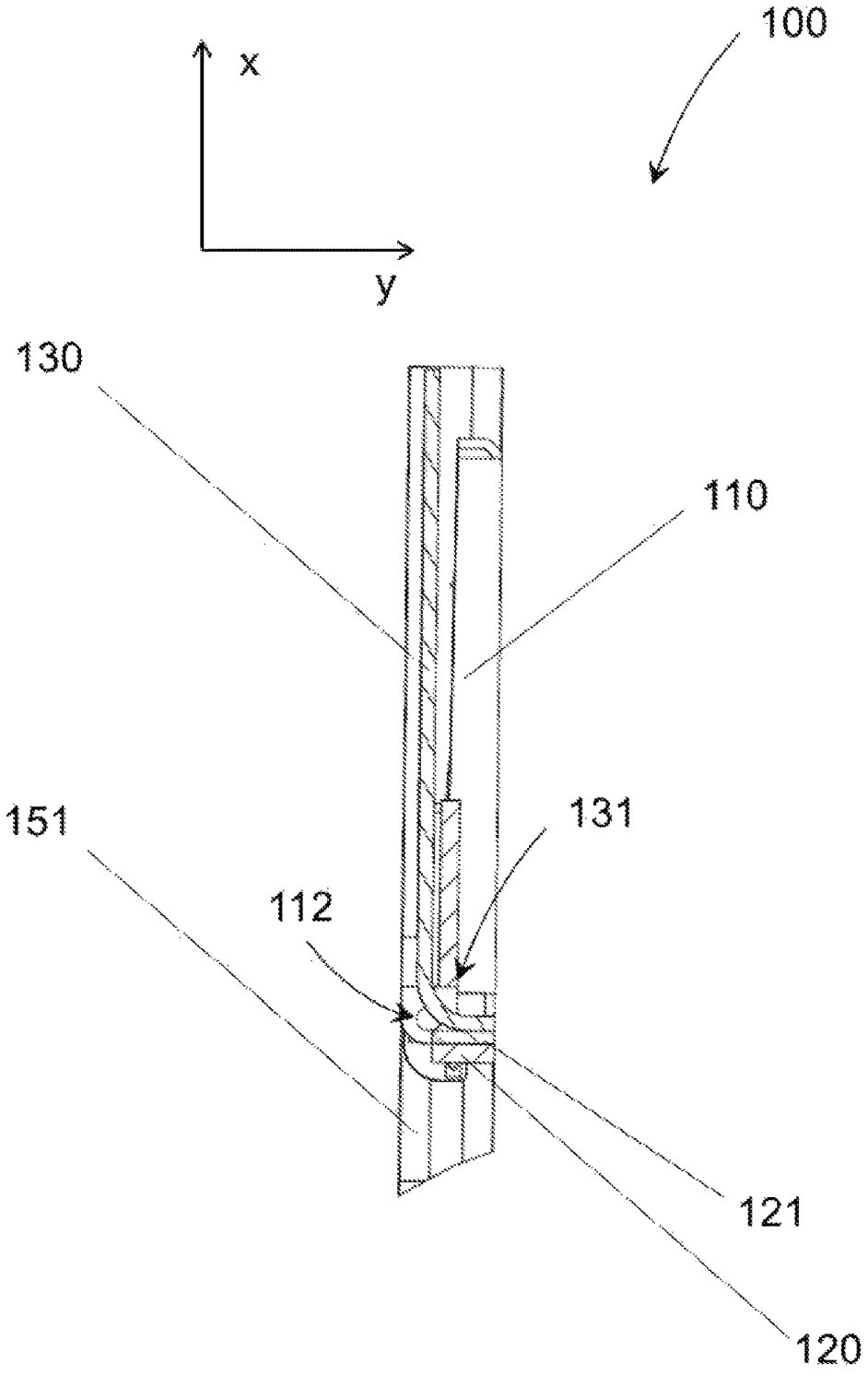

The figures show the following:

FIG. 1 a load-securing device according to the invention, on a lifting carriage, in a three-dimensional front view, with an activated holding element;

FIG. 2 a section of a load-securing device according to the invention, in a three-dimensional rear view, with an activated holding element;

FIG. 3 a load-securing device according to the invention, in a side view, with an activated holding element;

FIG. 4 a load-securing device according to the invention, in a top view, with an activated holding element;

FIG. 5 a load-securing device according to the invention, in a three-dimensional front view, with an activated holding element;

FIG. 6 a load-securing device according to the invention, in a three-dimensional front view, with a deactivated holding element;

FIG. 7 a section of a load-securing device according to the invention, in a sectional side view, with a deactivated holding element.

FIG. 1 shows a load-securing device 100 according to the invention, on a lifting carriage 150 in a three-dimensional front view, with an activated holding element 110. Two lifting forks 160 are installed as load pick-up elements on the lifting carriage 150. The load-securing device has two masts 151 whose length is $H_W$ and on which a holding element 110 is installed via a yoke 111. The holding element 110 is in the activated position, that is to say, in the position pivoted forward in the positive y-direction in the direction of the lifting forks 160. The frame-shaped holding element 110 is attached to the yoke 111 so that it can be pivoted around a hinge pin 112. The yoke 111 is connected to the masts 151 via height adjustment mechanisms 115 that are supported in the mast profiles, so as to move vertically, whereby at least one height adjustment mechanism 115 is configured as a hydraulic cylinder. Moreover, this view shows a gas compression spring 140 as an energy storage means, whereby the gas compression spring 140 exerts a force onto the holding element 110 that generates a torque around the hinge pin 112. The holding element 110 has an extension D in the direction of the lifting forks 160. Moreover, two guide rails 130 having a length $H_F$ are installed on the masts 151 and these guide rails 130 each end in the opposite x-direction with a curved track 131. The holding element 110 is in its highest position. In this position, a load can be picked up with the lifting forks 160. Once the load has been picked up, the holding element 110 can be lowered onto the load in the vertical direction opposite to the x-direction in order to thereby clamp the load between the lifting forks 160 and the holding element 110. Once the load has been clamped in this manner, it can be securely picked up and transported. The load-securing device 100 is attached to a lifting carriage 150 that bears the two lifting forks 160 and that can be moved vertically on a lifting frame (not shown here) of an industrial floor truck (not shown here).

FIG. 2 shows a section of a load-securing device 100 according to the invention, in a three-dimensional rear view, with an activated holding element 110. From this perspective, it can be seen that the gas compression spring 140, as a compression spring, is tensioned in the activated position of the holding element 110 shown. On the one hand, it engages with the holding element 100 itself and, on the other hand, with a lifting element 113 that is attached to the yoke 111. The hinge pin 112 is also mounted in this lifting element 113, whereby the gas compression spring 140 engages with the lifting element 113 opposite to the x-direction below the hinge pin 112, thereby generating a torque around the hinge pin 112. This torque acts in such a way that the holding element 110 would pivot upwards, that is to say, in the x-direction, if this were not prevented by the support elements 120 that act against the guide rail 130 via the wear elements 121. If the load-securing device continues to move vertically on the guide rails 130 opposite to the x-direction until the support elements 120 are situated in the area of the curved tracks 131 of the guide rails 130, then the support elements 120 can no longer counter the torque and the holding element 110 pivots upwards clockwise, that is to say, in the x-direction, around the hinge pin 112.

FIG. 3 shows a load-securing device 100 according to the invention in a side view, with an activated holding element 110. When the holding element is in the activated state, it has a horizontal extension D, measured between the hinge pin 112 and the maximum front extension. The masts 151 of the load-securing device 100 do not extend in the positive y-direction beyond the front edge of the lifting carriage 150 situated in the positive y-direction.

FIG. 4 shows a load-securing device 100 according to the invention in a top view, with an activated holding element 110. The load-securing device 100 has two masts 151, whereby a height adjustment mechanism 115 in the form of a hydraulic piston 115 operates in one of the masts 151. Via this hydraulic piston 115, the holding element 110 can be moved vertically, that is to say, in or opposite to the x-direction. In particular, in order to be activated, the deactivated holding element 110 can be moved vertically in the x-direction by means of the height adjustment mechanism 115 above the area 131 of the curved track in the guide rail 130 or else conversely, in order to be deactivated, the activated holding element 110 can be moved vertically opposite to the x-direction by means of the height adjustment mechanism 115 below the area 131 of the curved track in the guide rail 130. If the holding element 110 is activated, it can be moved by means of the height adjustment mechanism 115 vertically in the x-direction into a maximum position. In this position, a load can be picked up with the load pick-up element 160. When the load is resting on the load pick-up element 160, the holding element can be moved vertically by means of the height adjustment mechanism 115 opposite to the x-direction in such a way that it comes to rest on the surface of the load and the load is clamped between the load pick-up element 160 and the holding element 110, as a result of which the load can be picked up and transported securely.

FIG. 5 shows a load-securing device 100 according to the invention, in a three-dimensional front view, with an activated holding element 110. The holding element 110 is close to the lowermost position in which it is still activated, that is to say, in which the support element 120 is still situated in the vertical area of the guide rail 130 outside of the area 131 of the curved track. The guide rail 130 having the length $H_F$ is situated between the area 131 of the curved track in the guide rail 130 and the upper end of the guide rail 130 positioned in the x-direction, whereby, when the holding element 110 is in the activated state, it can be moved vertically over the length $H_F$. Here, $H_F$ is at least as large as the maximum extension D of the holding element 110 as seen from the hinge pin 112. Given these geometric relationships, when the holding element 110 is in the deactivated state, it can be swung aside, essentially perpendicular to the load pick-up element 160, so that the lifting carriage 150 can be used without being restricted by the load-securing device 100, even in all of those cases in which a load-securing device 100 is not necessary or is even a hindrance.

FIG. 6 shows a load-securing device 100 according to the invention, in a three-dimensional front view, with a deactivated holding element 110. In this case, $H_F$ is greater than the extension D of the holding element 110. The holding element 110 is pivoted essentially perpendicular to the load pick-up element 160, that is to say, into the vertical position essentially parallel to the masts 151. As a result, the entire depth of the load pick-up element 160 is available to pick up a load. No parts of the load-securing device 100 protrude beyond the masts 151. Consequently, the movable parts of the load-securing device 100 are in a protected position. The masts 151 themselves do not protrude beyond the lifting carriage 150 in the positive y-direction, so that the maximum depth of the lifting forks 160 is available for picking up the load.

FIG. 7 shows a section of a load-securing device 100 according to the invention in a sectional side view, with a deactivated holding element 110. The guide rail 130 is shown with the area 131 of the curved track. The support element 120 and the wear element 121 are likewise shown in a sectional view, whereby the holding element 110 is pivoted around the hinge pin 112 into a vertical position.

The embodiments shown here are merely examples of the present invention and should not be construed in any limiting manner. Alternative embodiments considered by a person skilled in the art are likewise encompassed by the protective scope of the present invention.

LIST OF REFERENCE NUMERALS

100 load-securing device
110 holding element
111 yoke
112 hinge pin, articulation
113 lifting element
115 height adjustment mechanism, hydraulic piston
120 support element
121 wear element
130 guide rail
131 area of the curved track in the guide rail
140 energy storage means
150 lifting carriage
151 mast
160 load pick-up element, lifting fork
D extension of the holding element
$H_F$ length of the guide rail
$H_M$ mast length

The invention claimed is:

1. A load-securing device, having at least one mast as well as a holding element, a support element and a guide rail, whereby the load-securing device is arranged on the at least one mast so that it can be moved vertically in or opposite to the x-direction, the guide rail has a part that extends parallel to the at least one mast, and the support element can be made to engage with this part of the guide rail, whereby the support element is supported by the guide rail, whereby the holding element is arranged so that it can be pivoted around a hinge pin, whereby the holding element can be activated by being pivoted into a horizontal position, whereby the pivoting of the holding element in the vertical direction (x) is prevented by the support element when the support element is engaged with the part of the guide rail that extends parallel to the at least one mast, characterized in that the guide rail further includes an area with a curved track; and the load-securing device further including an energy storage means, wherein when the holding element is in a horizontal position, the energy storage means is tensioned and exerts a torque on the holding element around the hinge pin in a direction that pivots the holding element into a deactivated state.

2. The load-securing device according to claim 1, characterized in that the holding element can be pivoted in the positive x-direction.

3. The load-securing device according to claim 1, characterized in that the holding element can be pivoted in the negative x-direction.

4. The load-securing device according to claim 1, characterized in that when the holding element is in an vertical position in the positive y-direction, it does not extend in the positive y-direction beyond the maximum extension of the at least one mast.

5. The load-securing device according to claim 1, characterized in that the load-securing device also has a yoke, whereby the holding element can be pivoted relative to the yoke around the pivot point in the vertical direction (x).

6. The load-securing device according to claim 5, characterized in that the yoke and the holding element can be moved vertically in the same direction in the x-direction or in the opposite x-direction, whereby their vertical distance remains constant.

7. The load-securing device according to claim 1, characterized in that the energy storage means is a compression spring.

8. The load-securing device according to claim 1, characterized in that the support element has a wear element with which the support element is supported on the guide rail.

9. The load-securing device according to claim 8, characterized in that the wear element is a roller.

10. The load-securing device according to claim 8, characterized in that the wear element is a sliding beam.

11. The load-securing device according to claim 1, characterized in that the guide rail is operatively connected to the at least one mast.

12. The load-securing device according to claim 1, characterized in that a lifting carriage is attached to the at least one mast, the lifting carriage having a height adjustment mechanism for the load-securing device by means of which the load-securing device can be adjusted in the vertical direction (x) along the guide rail.

13. The load-securing device according to claim 12, characterized in that the height adjustment mechanism is integrated into the at least one mast.

14. The load-securing device according to claim 1, characterized in that the holding element has a maximum extension D from the hinge pin in the direction opposite from the hinge pin, whereby the length $H_F$ of the guide rail corresponds to at least the extension D of the holding element.

15. A lifting carriage, characterized in that the lifting carriage has a load-securing device according to claim 1.

* * * * *